US006280250B1

(12) United States Patent
Ko

(10) Patent No.: US 6,280,250 B1
(45) Date of Patent: Aug. 28, 2001

(54) ELECTRICAL CONNECTOR WITH TERMINAL RETAINING MEANS

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/626,937

(22) Filed: Jul. 27, 2000

Related U.S. Application Data

(63) Continuation-in-part of application No. 09/207,080, filed on Dec. 7, 1998, now Pat. No. 6,120,333.

(51) Int. Cl.[7] ..... H01R 13/40
(52) U.S. Cl. ..... 439/595; 439/748
(58) Field of Search ..... 439/746, 751, 439/752, 752.5, 748, 595

(56) References Cited

U.S. PATENT DOCUMENTS 3,083,345 * 3/1963 Scheller ..... 439/748
3,550,067 * 12/1970 Hansen ..... 439/748
3,711,819 * 1/1973 Matthews ..... 439/748
4,214,361 * 7/1980 Coldren et al. ..... 439/748
5,161,990 * 11/1992 Ling et al. ..... 439/174
5,489,223 * 2/1996 Faje et al. ..... 439/748
5,984,736 * 11/1999 Sakurai et al. ..... 439/748
5,993,268 * 11/1999 Yamaguchi ..... 439/752.5
6,120,333 * 9/2000 Ko ..... 439/748

* cited by examiner

*Primary Examiner*—Brian Sircus
*Assistant Examiner*—Hae Moon Hyeon
(74) *Attorney, Agent, or Firm*—Wei Te Chung

(57) ABSTRACT

A receptacle-type electrical connector (1) for connecting conductors of a wire to pin terminals of a complementary connector comprises a dielectric housing (10) defining an array of terminal passageways (11) therein and corresponding receptacle terminals (30) assembled in the terminal passageways. The housing has front and rear faces and having front and rear openings **(11*b*, 11*c*). A dam (13) is formed in each terminal passageway. A wedge (13*a*) rearwardly extends from the dam thereby defining a retaining gap (13*b*) in the passageway (11). Each terminal includes a base (30*a*). The base (30*a*) has a pair of first resilient arms (31) extending from a front portion thereof and adapted for engaging with a pin terminal of the complementary connector, a pair of second resilient arms (32) extending from a middle portion thereof, and tongue (34) projecting forward for being securely retained within the gap. The housing further forms a plurality of cantilevered flaps (12) extending forwardly from the rear face toward the front face, and a retaining space (12*d*) is defined at a front of each flap for retaining an anchoring foot (35)** of the terminal. A cutout is positioned in the front portion of the base to increase resiliency of the first resilient arms.

10 Claims, 9 Drawing Sheets

ELECTRICAL CONNECTOR WITH TERMINAL RETAINING MEANS

RELATED APPLICATION

This application is a continuation-in-part (CIP) application of application Ser. No. 09/207,080 filed Dec. 7, 1998 now U.S. Pat. No. 6,120,333 by the same inventor and entitled "Electric Connector With Terminal Retaining Means".

BACKGROUND OF THE INVENTION

1. Field of the Invention

The present invention relates to an electrical connector, and more particularly to an electrical connector with terminal retaining means for reliably and quickly positioning terminals therein.

2. Description of Prior Art

A variety of mating connectors employ pairs of interengaging terminals for connecting conductive wires to other circuit elements through the mated connectors. The terminal pairs may be pin and socket terminals. Conventionally, terminals are assembled in an array of passageways of a dielectric housing of the connector. Each terminal is inserted into a corresponding passageway along a longitudinal axis of the passageway and retaining means integrally formed on the terminal securely retain the terminal therein.

Properly retaining the terminals in position within the passageways of such housings is problematic. Instability of the terminals results in terminal movement within the housing, particularly in transverse or angular directions with respective to the longitudinal axes of the passageway. Transverse or angular movement of a terminal causes terminal-to-terminal misalignment between complementary connectors, which may damage one or both of the mating terminals thereby resulting in partial or incomplete electrical connection. It is readily understood that pin and receptacle terminals must be properly positioned, stabilized and centered in order to accurately mate with corresponding receptacle and pin terminals. Such positioning is becoming more critical with the increasing miniaturization of electrical connectors.

U.S. Pat. No. 5,664,969 (hereinafter referred to as the '969 patent) discloses an electrical connector adapted for connecting a conductor of an electrical wire to a terminal of a mating connector. The '969 patent discloses a pair of elongate slots defined in a wall by a cavity of a dielectric housing. The terminal is provided with a free end portion which can be tightly received within the slots. By this arrangement, the terminal inserted into the cavity is prevented from transverse or angular movement. However, the structure of both the cavity and terminal is complicated.

In addition, when the engaging area of a mating pair of terminals increases, the force between the increases correspondingly. Therefore, larger terminals having larger contacting areas experience larger forces during mating. Thus, reduction of these forces during mating between larger terminals is desired.

SUMMARY OF THE INVENTION

An objective of this invention is to provide an electrical connector with terminal retaining means for reliably and quickly positioning terminals therein.

Another objective of this invention is to provide an electrical connector terminal which provides a mating force in a controlled range when engaging with a corresponding mating terminal.

To achieve these object, an electrical connector for connecting conductors of a conductive wire to a terminal of a complementary connector comprises a dielectric housing having an array of terminal passageways defined therein and a terminal inserted in each passageway. The housing has front and rear faces, and the passageways are defined between said front and rear faces and have front and rear openings. A dam is formed in each terminal passageway. A wedge rearwardly extends from the dam thereby defining a retaining gap in the passageway. Terminals are assembled in the terminal passageways and include a base. The base has a pair of first resilient arms extending upward from a front portion of the base and adapted for engaging with a pin terminal of the complementary connector, a pair of second resilient arms extending upward from a middle portion of the base for clamping the conductor of the wire, a pair of third resilient arms extending upward from a rear portion of the base for clamping the insulation of the wire, and a tongue projecting forward from a front edge of the front portion of the base and being securely retained within the gap. The housing further forms a plurality of cantilevered flaps extending forward from the rear face toward the front face, and a retaining space is defined at a front of each flap for retaining an anchoring foot of the terminal. In a second embodiment, a cutout divides the mating portion into two sections for reducing the normal force between the receptacle terminal and the mating terminal.

These and additional objectives, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
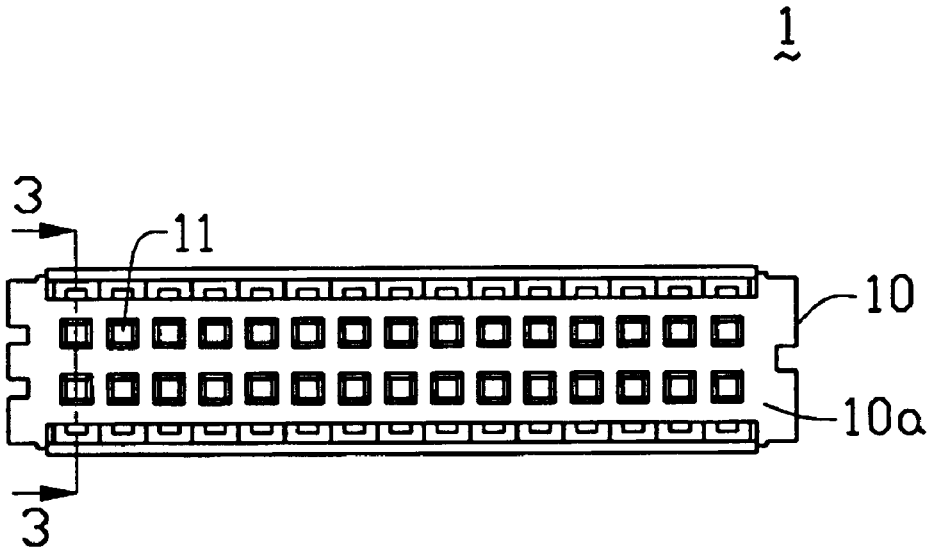
FIG. 1 is a front view of a housing of an electrical connector in accordance with the present invention.
Figure 2:
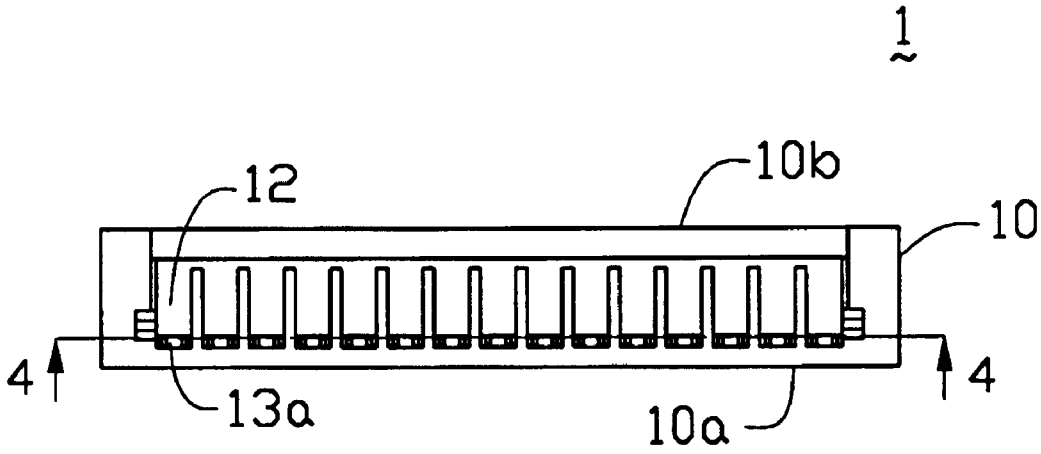
FIG. 2 is a top plan view of the electrical connector of FIG. 1.

Referring to FIGS. 1 to 5, a receptacle connector 1 comprises a dielectric housing 10 forming a front face 10*a* and rear face 190*b*. An array of terminal passageways 11 is defined between the front and rear faces 10*a*, 10*b*. Each upper passageway 11 is symmetrically arranged with a corresponding lower passageway 11. Each passageway 11 has an open ceiling 11*a* forward a top or a bottom side (not labeled) of the housing 10 exposed to an outside which is partially covered by a flap 12 cantilevered forward from the rear face 10*b*. The flap 12 forms a block 12*a* having an inclined face 12*b* and a biasing face 12*c*. A retaining space 12*d* is defined between the biasing face 12*c* and a free end of the flap 12. Each passageway 11 defines front and rear openings 11*b*, 11*c* for receiving a receptacle terminal 30 (only one terminal 30 being assembled therein for simplicity) and defines a front opening 11*b* and a rear opening 11*c*. A dam 13 is formed near the front opening 11*b*. A wedge 13*a* rearwardly extends from the dam 13 thereby defining a retaining gap 13*b* in the passageway 11.

Figure 6:
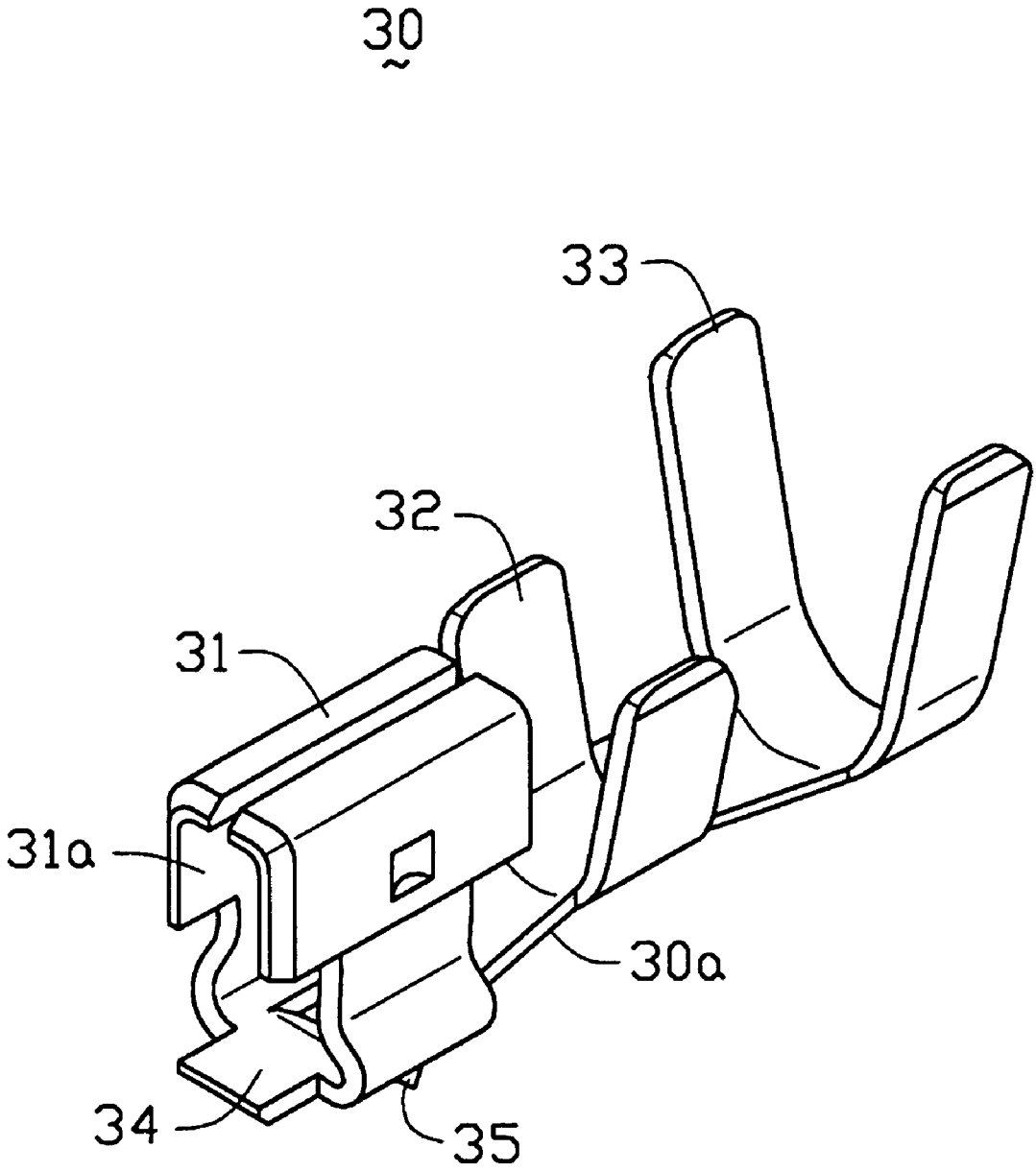
FIG. 6 is a perspective view of the terminal of FIG. 3.
Figure 7:
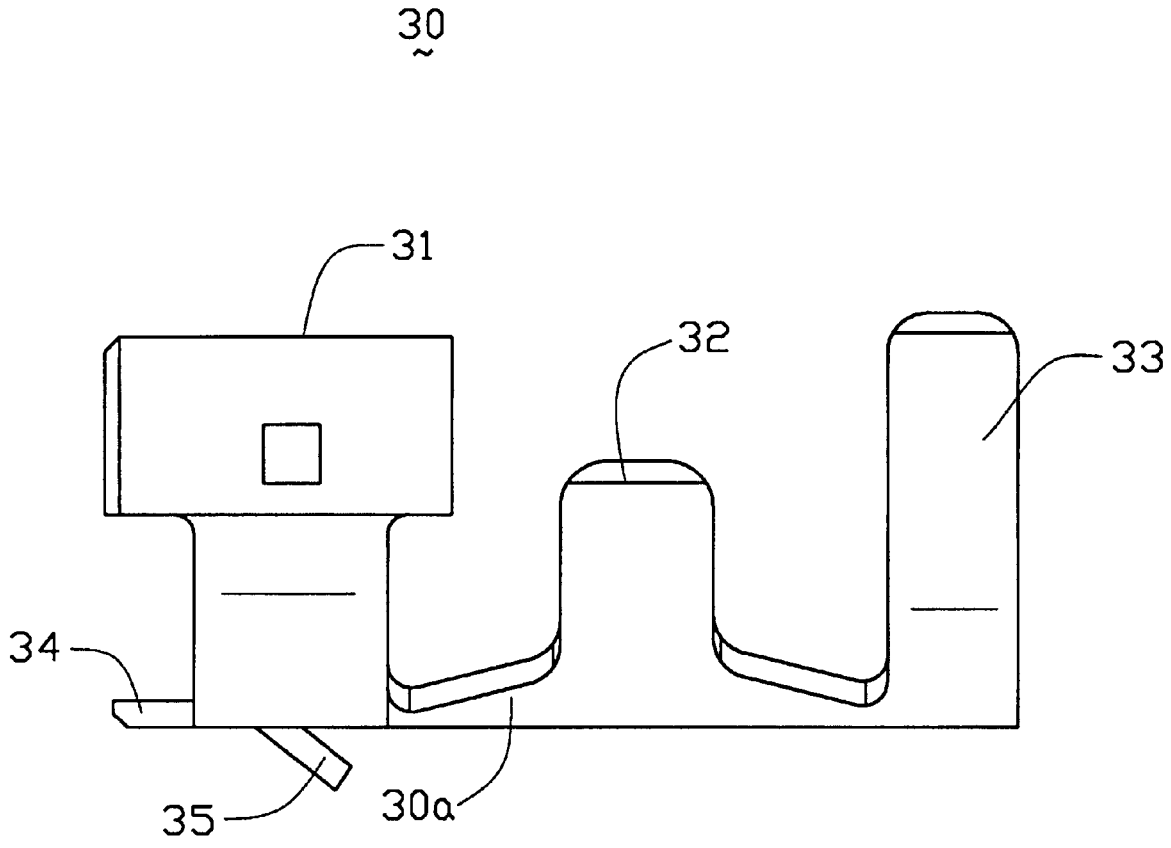
FIG. 7 is a side elevational view of the terminal of FIG. 6.
Figure 8:
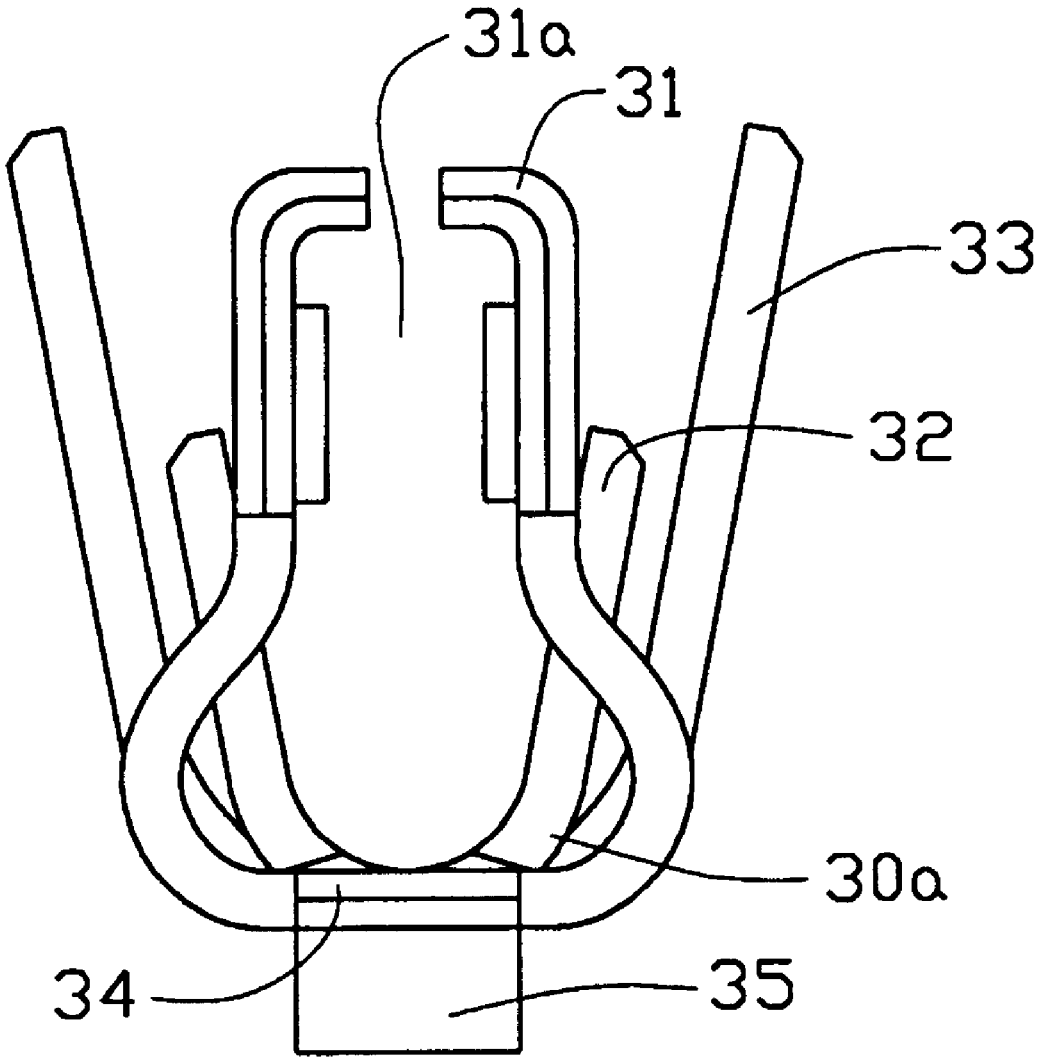
FIG. 8 is a front end view of the terminal of FIG. 6.

Referring to FIGS. 6 to 8, the receptacle terminal 30 includes an elongate base 30*a*. A pair of first resilient arms 31 extends upward from a front portion of the base 30*a* and defines a receiving space 31*a* therebetween for receiving the corresponding pin terminal (not shown) of a complementary connector. The receiving space 31*a* aligns with the front opening 11*b* of the passageway 11. A pair of second resilient arms 32 extends upward from a middle portion of the base 30*a*. The second resilient arms 32 are for use in clamping a conductor of a wire (not shown). A pair of third resilient arms 33 extends upward from a rear portion of the base 30*a* for clamping the insulation of the wire. A tongue 34 projects forward from a front edge of the base 30*a*. An anchoring foot 35 rearwardly extends from the front portion of the base 30*a*.

Figure 3:
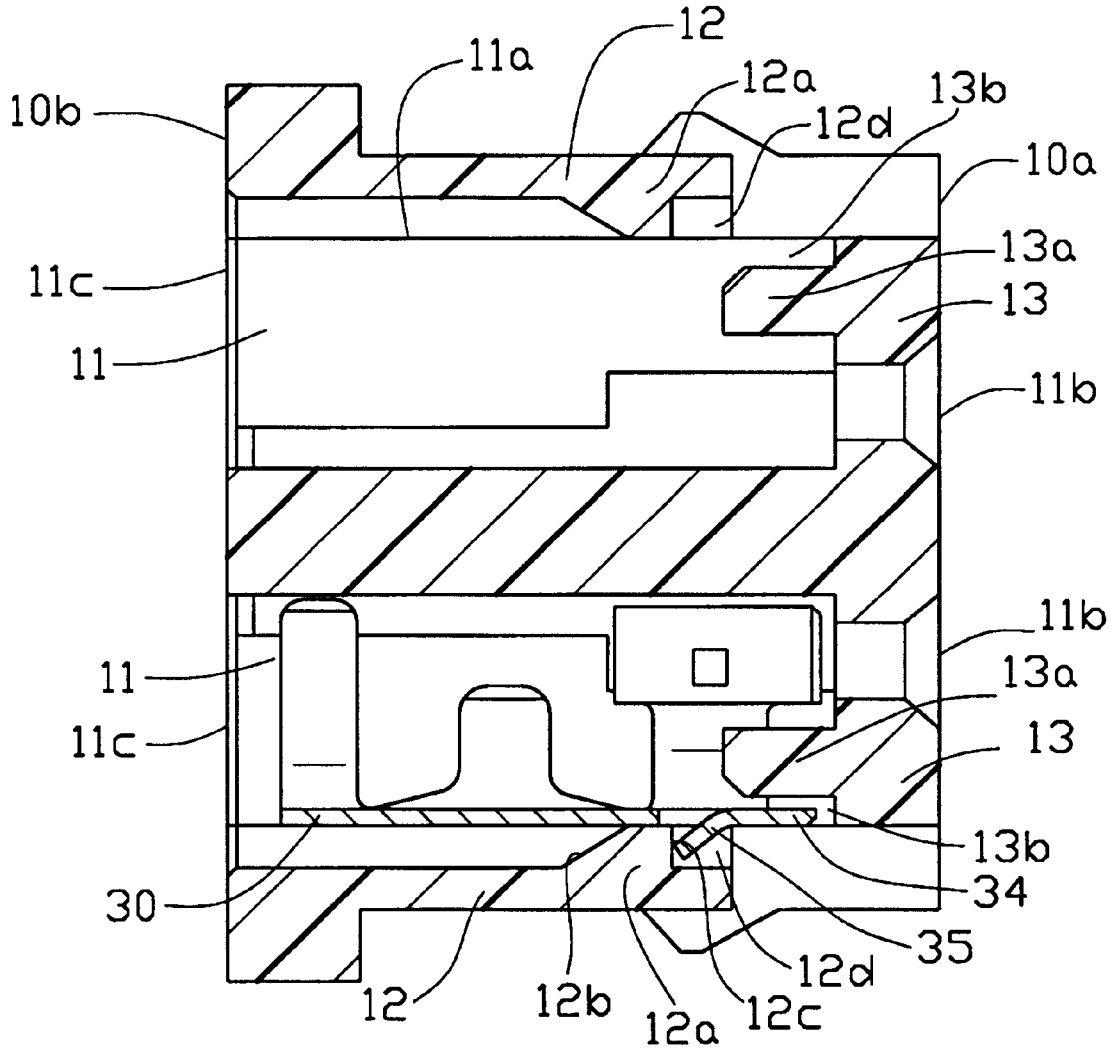
FIG. 3 is a cross sectional view taken along line 3—3 of FIG. 1 with a terminal in accordance with a first embodiment of the present invention shown.
Figure 4:
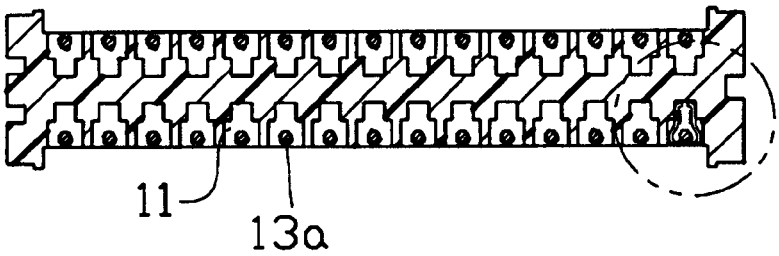
FIG. 4 is a cross sectional view taken along line 4—4 of FIG. 2 with a terminal in accordance with a first embodiment of the present invention shown.
Figure 5:
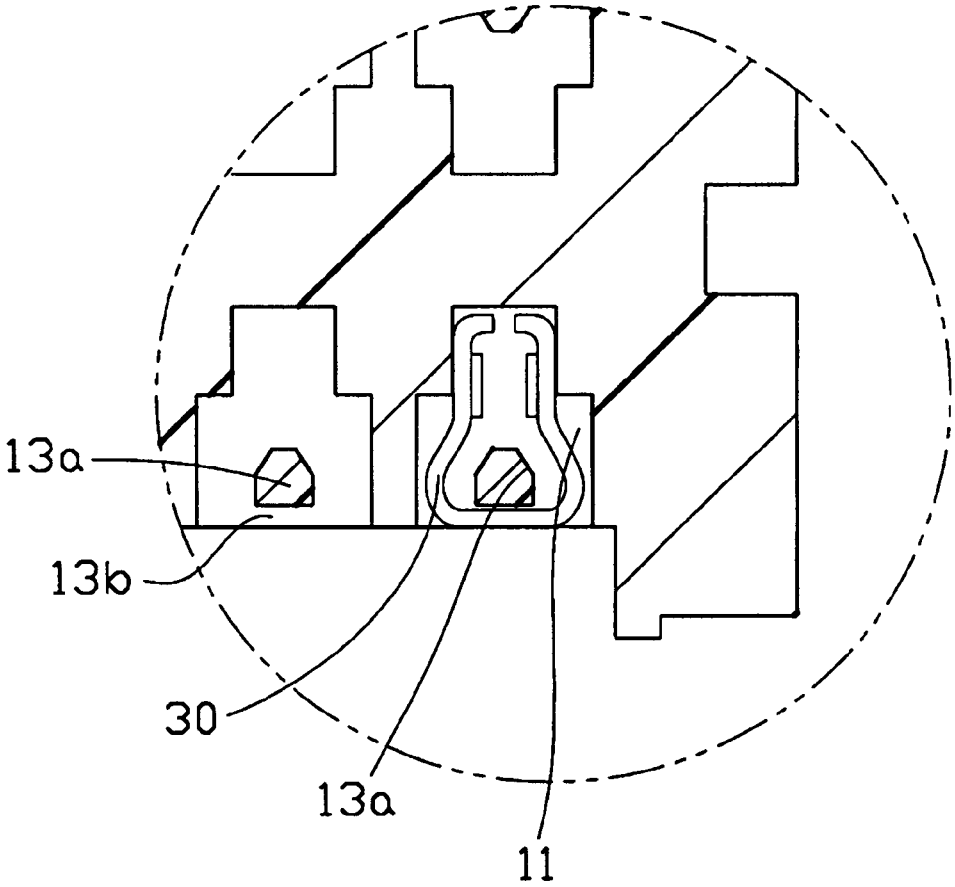
FIG. 5 is an enlarged view of a portion of FIG. 4 indicated by a circle.

As shown in FIG. 3, when the receptacle terminal 30 is inserted into the passageway 11 from the rear opening 11*c*, the anchoring foot 35 slides over the inclined face 12*b* to push the flap 12 outward. The anchoring foot 35 is finally retained within the retaining space 12*d* after the anchoring foot 35 passes the biasing face 12*c*. Meanwhile, the tongue 34 is securely received in the gap 13*b* whereby an angular movement of the receptacle terminal 30 is hindered. The flap 12 resumes its original position and the receptacle terminal 30 is securely positioned within the passageway 11.

Figure 9:
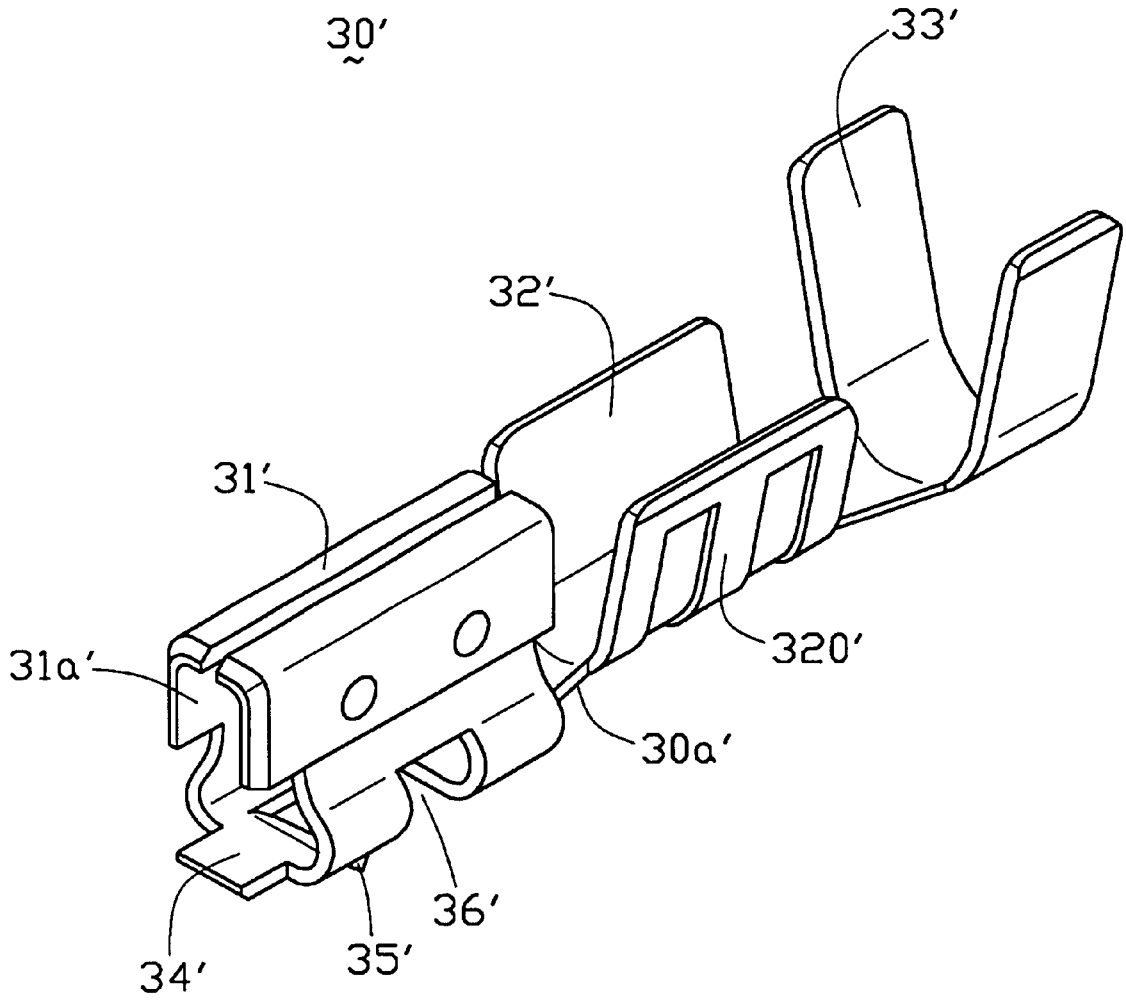
FIG. 9 is a perspective view of a terminal used with the electrical connector in accordance with a second embodiment of the present invention.
Figure 10:
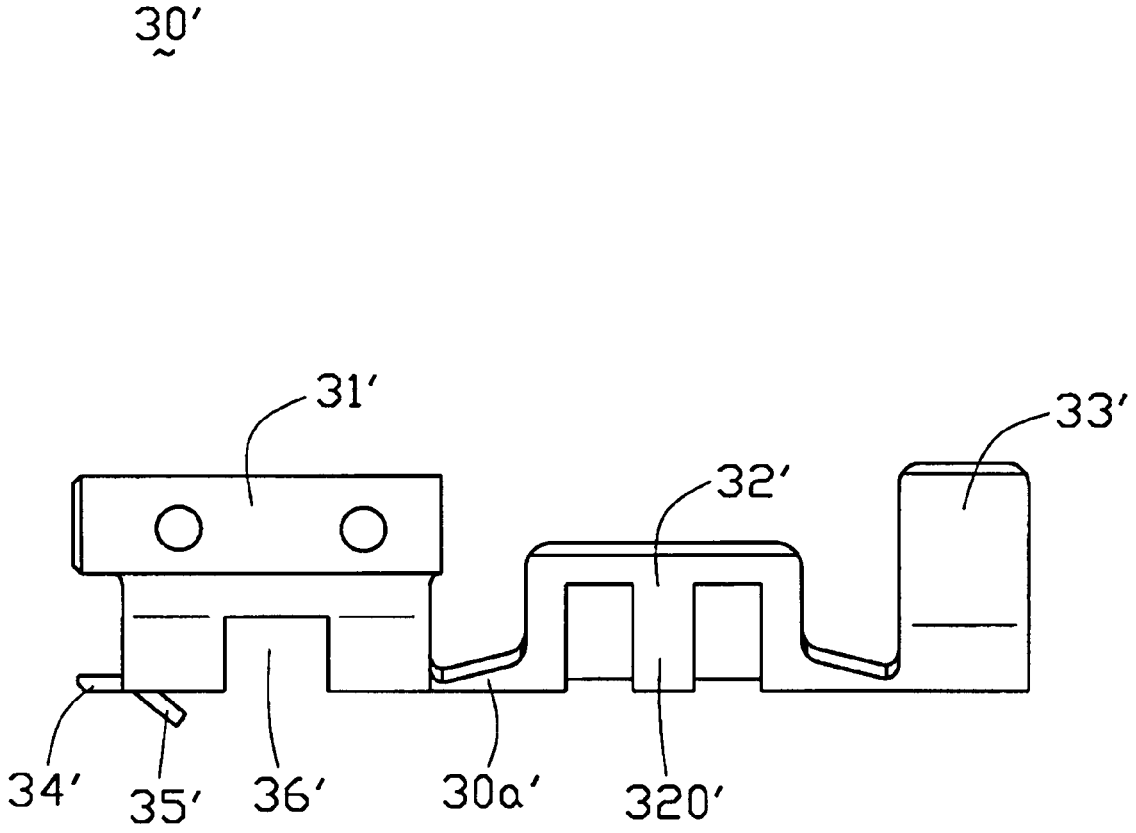
FIG. 10 is a side elevational view of the terminal of FIG. 9.
Figure 11:
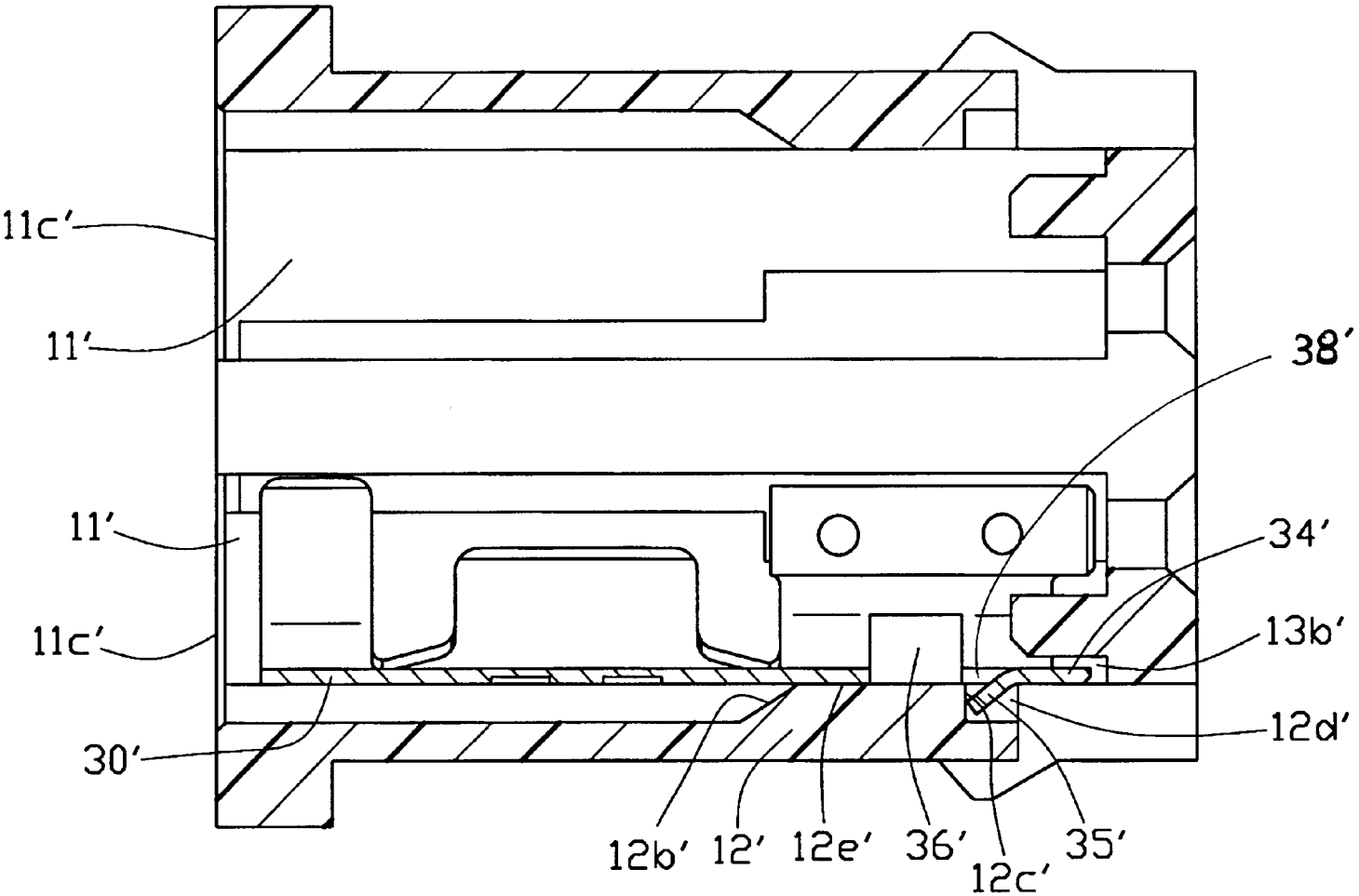
FIG. 11 is a cross sectional view of an electrical connector with the terminal in accordance with the second embodiment.

FIGS. 9 and 11, an electrical connector with receptacle terminals 30' in accordance with of a second embodiment of the present invention is shown. The second embodiment of both the connector and the receptacle terminals has an increased length in comparison with the first embodiment, resulting in each receptacle terminal 30' having a longer elongated base 30*a*'. A pair of first resilient arms 31' extends upward from a front portion (not labeled) of the base 30*a*' and defines a receiving space 31*a*' therebetween for receiving a corresponding pin terminal (not shown). A pair of second resilient arms 32' extends upward from a middle portion of the base 30*a*' for clamping a conductor of a wire. The second resilient arms 32' are stamped with a rib 320' at a middle portion of a lower face thereof to increase the strength of the arms. A pair of third resilient arms 33' extends upward from a rear portion of the base 30*a*' for clamping the insulation of the wire. A tongue 34' extends forward from a front edge of the front portion of the base 30*a*'. In addition, a cutout 36' is defined in the front portion of the base 30*a*', and an anchoring foot 35' is stamped downwardly from an edge facing the cutout 36', and generally positioned between the tongue 34' and the cutout 36', wherein the cutout 36' is communicative with another cutout 38' which is formed after 3the anchoring foot 35' has been downwardly stamped out.

As shown in FIG. 11, when the receptacle terminal 30' is inserted into the passageway 11' from the rear opening 11*c*', the anchoring foot 35' first slides over the inclined face 12*b*'. The anchoring foot 35' is finally retained within the retaining space 12*d*' after the anchoring foot 35' passes the biasing face 12*c*'. The tongue 34' is securely received in the gap 13*b*' whereby an angular movement of the receptacle terminal 30' is hindered. The flap 12', which is pushed outward by the anchoring foot 35' during the assembling process, resumes its original position after the receptacle terminal 30' is securely positioned within the passageway 11*c*'. The cutout 36' moves past the inclined face 12*b*' to a position on the upper face 12*e*' during this process.

In the second embodiment, since the first resilient arms 31' have a relatively large longitudinal dimension, a relatively large force is required to insert/withdraw the pin into/from the receiving space 31*a*'. Such a large insertion force unfavourably affects the mating and unmating of the connector with the complementary pin connector, and thus the service life of the receptacle/pin terminals and the connector system may be shortened. The cutout 36' with the communicating cutout 38' is formed to make the first resilient arms more resilient, allowing the lengthened connector of the second embodiment to perform better and to last longer. A ring shaped recess might also be used in place of the cutout 36'.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector for connecting conductors of a conductive wire to pin terminals of a complementary connector, comprising:

a dielectric housing having front and rear faces, an array of terminal passageways defined between said front and rear faces, each passageway having front and rear openings, a dam being formed near said front opening, a wedge rearwardly extending from said dam thereby defining a retaining gap in said passageway; and a plurality of receptacle terminals assembled in said terminal passageways, each receptacle terminal including a base, said base having a pair of first resilient arms extending from a front portion of the base and adapted for engaging with the pin terminal of the complementary connector, a pair of second resilient arms extending from a middle portion of the base and adapted for engaging the conductor of the wire, a pair of third resilient arms extending from a rear portion of the base and adapted for engaging with insulation of the wire, and a tongue projecting forwardly from a front edge of the front portion of the base and being securely retained within said gap, a cutout positioned in the front portion of the base to increase resiliency of the first resilient arms.

2. The electrical connector as recited in claim 1, wherein said dielectric housing forms a plurality of cantilevered flaps extending forwardly from the rear face toward the front face, each flap partially bounding a longitudinal side of a corresponding terminal passageway.

3. The electrical connector as recited in claim 2, wherein each of said flaps forms a block having an inclined face and a biasing face.

4. The electrical connector as recited in claim 3, wherein an upper face is located between the inclined face and the biasing face, and the cutout is positioned on the upper face.

5. The electrical connector as recited in claim 4, wherein an anchoring foot is formed by the front portion of the base positioned to the near of the tongue and securely abuts against the biasing face.

6. The electrical connector as recited in claim 5, wherein a retaining space is defined between said biasing face and a front end of said flap, said anchoring foot extending into the retaining space.

7. An electrical connector for connecting conductors of a wire to pin terminals of a complementary connector, comprising:

a dielectric housing having front and rear faces, an array of terminal passageways defined between said front and rear faces, each passageway having front and rear openings and a retaining gap; and a plurality of receptacle terminals assembled in said terminal passageways, each receptacle terminal including a base, said base having a pair of first resilient arms extending from a front portion of the base for engaging a pin terminal, a pair of second resilient arms extending from a middle portion of the base, a pair of third resilient arms extending from a rear portion of the base, and a tongue projecting from a front edge of the front portion of the base for fitting into the retaining gap, a cutout defined positioned in the front portion of the base to reduce rigidity of the front resilient arms, and an anchoring foot formed between the tongue and the cutout for securely abutting a biasing face of a corresponding cantilevered flap of the housing.

8. The electrical connector as recited in claim 7, wherein the housing forms a dam near the front opening, a wedge rearwardly extending from said dam to define the retaining gap in said passageway into which the tongue extends.

9. An electrical connector comprising:

a dielectric housing having front and rear faces with an array of terminal passageways defined therebetween, a plurality of flaps extending forwardly from the rear face in communication with the corresponding terminal passageways, respectively, each of said flaps forming thereon a block with a retaining space aside;

a plurality of receptacle terminals assembled in said terminal passageways, respectively, each of said receptacle terminals including a base with pairs of resilient arms extending on two sides thereof; and an anchoring foot formed around a front portion of the base; wherein the front portion of the base is seated upon the block with the anchoring foot abutting against the block for preventing rearward movement of the receptacle terminal relative to the housing; and wherein a cutout is formed in the front portion of the base of each of said receptacle terminals in communication with the anchoring foot.

10. The connector as recited in claim 9, wherein a dam is formed around a front portion of the housing in each of said terminal passageways and received within the corresponding receptacle terminal.

* * * * *